US007201569B2

(12) United States Patent
Hossner

(10) Patent No.: US 7,201,569 B2
(45) Date of Patent: Apr. 10, 2007

(54) SCREW COMPRESSOR

(75) Inventor: Klaus Hossner, Magstadt (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 11/144,150

(22) Filed: Jun. 2, 2005

(65) Prior Publication Data

US 2005/0226758 A1 Oct. 13, 2005

Related U.S. Application Data

(63) Continuation of application No. PCT/EP2003/013224, filed on Nov. 25, 2003.

(30) Foreign Application Priority Data

Dec. 3, 2002 (DE) ..... 102 58 136
Dec. 4, 2002 (DE) ..... 102 58 145

(51) Int. Cl.
*F03C 2/00* (2006.01)
*F03C 18/00* (2006.01)

(52) U.S. Cl. ..... 418/201.2; 418/87; 418/201.1

(58) Field of Classification Search ..... 418/201.1, 418/201.2, 85, 87, 97; 62/505, 508
See application file for complete search history.

(56) References Cited

U.S. PATENT DOCUMENTS 3,568,466 A * 3/1971 Brandin et al. ..... 62/510
3,874,828 A 4/1975 Herschler et al.
3,913,346 A 10/1975 Moody, Jr. et al.
4,025,244 A * 5/1977 Sato ..... 418/87
4,062,199 A 12/1977 Kasahara et al.
4,074,957 A 2/1978 Clarke et al.
4,220,197 A * 9/1980 Schaefer et al. ..... 165/263
4,545,742 A 10/1985 Schaefer
4,727,725 A * 3/1988 Nagata et al. ..... 418/201.2
4,748,831 A * 6/1988 Shaw ..... 62/505
6,276,911 B1 8/2001 Krusche et al.

(Continued)

FOREIGN PATENT DOCUMENTS

DE 2 134 181 11/1973

(Continued)

*Primary Examiner*—Theresa Trieu
(74) *Attorney, Agent, or Firm*—Lipsitz & McAllister, LLC

(57) ABSTRACT

Disclosed is a screw compactor comprising two screw rotors which are disposed in screw rotor bores inside a compressor housing and compress a coolant that enters at a coolant inlet and discharge said coolant at a coolant outlet, and a coolant inlet that is arranged within the compressor housing, said coolant being supplied by a coolant-injecting device via a conduit system in order to additionally cool the screw compressor. The inlet is disposed so as to extend into compression spaces that are enclosed by the screw rotors and the screw rotor bores. The aim of the invention is to create a screw compactor in which the compressive oscillations occurring at the inlet do not travel at all or only in an attenuated manner into the conduit system for the coolant-injecting device. Said aim is achieved by mounting a first inlet duct section which runs inside the compressor housing upstream of the inlet, an injection port for the coolant that is supplied by the coolant-injecting device extending into said first inlet duct section, while making a cross-sectional area of the injection port more than about four times smaller than a cross-sectional area of the first inlet duct section.

15 Claims, 4 Drawing Sheets

U.S. PATENT DOCUMENTS

2004/0040332 A1 3/2004 Roelke et al.

FOREIGN PATENT DOCUMENTS

| | | | | |
|---|---|---|---|---|
| DE | 37 06 583 | 9/1988 | | |
| DE | 199 47 823 | 4/2001 | | |
| DE | 102 42 139 | 3/2004 | | |
| EP | 1 072 796 | 1/2001 | | |
| GB | 1 237 333 | 6/1971 | | |
| GB | 1 256 391 | 12/1971 | | |
| GB | 1 454 979 | 11/1976 | | |
| GB | 1 483 848 | 8/1977 | | |
| JP | 57206794 A | * 12/1982 | | ..... 418/201.2 |

* cited by examiner

SCREW COMPRESSOR

This application is a continuation of international application number PCT/EP2003/013224 filed on Nov. 25, 2003.

The present disclosure relates to the subject matter disclosed in international application number PCT/EP2003/013224 of Nov. 25, 2003 and German applications number 102 58 136.3 of Dec. 3, 2002 and number 102 58 145.2 of Dec. 4, 2002, which are incorporated herein by reference in their entirety and for all purposes.

BACKGROUND OF THE INVENTION

The invention relates to a screw compressor, comprising two screw rotors, which are disposed in screw rotor bores in a compressor housing, compress a refrigerant that enters at a refrigerant inlet and allow the refrigerant to leave at a refrigerant outlet, and an inlet, which is provided in the compressor housing, for refrigerant, which is supplied by a refrigerant injection via a conduit system, for additional cooling of the screw compressor, the inlet being disposed in such a manner that it opens out in compression spaces surrounded by the screw rotors and the screw rotor bores.

Screw compressors of this type are known from the prior art; in these known screw compressors, the inlet which is also provided, in structural terms, for the use of a supercooling circuit is provided as an inlet for the injection of refrigerant.

With screw compressors of this type, the problem arises that on account of the fact that the compression spaces surrounded by the screw rotors and screw rotor bores move past the inlet, pressure oscillations or pulsations occur, propagate through the conduit system of the refrigerant injection and lead to noise, and in the most serious case even to damage or sealing problems.

Therefore, the invention is based on the object of providing a screw compressor in which the pressure oscillations which occur at the inlet as far as possible do not propagate, or do so only in attenuated form, into the conduit system for the refrigerant injection.

SUMMARY OF THE INVENTION

In a screw compressor of the type described in the introduction, this object is achieved, according to the invention, by the fact that connected upstream of the inlet is a first inlet passage section, which runs within the compressor housing and into which an injection opening for the refrigerant supplied by the refrigerant injection opens out, and that a cross-sectional area of the injection opening is smaller by more than a factor of approximately four than a cross-sectional area of the first inlet passage section.

The provision of the injection opening, via which the refrigerant is injected into the inlet passage section in the compressor housing, means that it is possible to prevent the propagation of pressure oscillations or pulsations beyond the first inlet passage section and thereby to avoid the production of noise in the conduit system of the refrigerant injection, since reducing the cross section of the injection opening prevents unattenuated propagation of pressure oscillations or pulsations beyond the first inlet passage section.

It is even more favorable if the injection opening has a cross-sectional area which is smaller by more than a factor of approximately 10, or better approximately eighty, or even better approximately one hundred, than the cross-sectional area of the first inlet passage section.

There is a very wide range of options in terms of the positioning of the injection opening. By way of example, it would be conceivable for the compressor housing to be formed in such a way that the injection opening itself is provided directly in the compressor housing, or alternatively a receiving part for the injection opening is provided, it being possible for the injection opening to be located at the entry of the first inlet passage section, to the side of the first inlet passage section.

A solution which is particularly simple in structural terms and is suitable in particular for the conversion of screw compressors with an inlet passage for a conventional supercooling circuit, provides for the injection opening to be provided in an insert part which is fitted into the inlet passage, in a second inlet passage section, adjoining the first inlet passage section, of the compressor housing.

Therefore, this insert part allows an injection opening to be realized in a simple way in the screw compressors of conventional structure.

In this case, it is expedient for the insert part to be formed in such a way that it has a feed passage leading to the injection opening, so that in the simplest case the refrigerant passing through the injection opening can be fed to the injection opening via the feed passage.

In this case, it is preferably provided that the feed passage has a larger cross-sectional area than the injection opening, so that the feed passage represents a negligible flow resistance compared to the injection opening.

With regard to the positioning of the insert part in the inlet passage section, it has proven particularly expedient for the insert part to be fixed in the second inlet passage section.

In this case, the insert part could be fixed in the second inlet passage section by a very wide range of holding means, such as for example by adhesive bonding or a positively locking fixing element, such as for example a securing ring or a screw thread.

In this context, a particularly advantageous option provides for the insert part to extend from an outer connection on the compressor housing into the second inlet passage section.

This provides the option of fixing the insert part in the region of the outer connection in a simple way.

In this case, it is preferable for the feed passage also to run from the outer connection in the insert part to the injection opening.

There is a very wide range of options in terms of the positioning of the first inlet passage section in the compressor housing. For example, various housing sections of the compressor housing could be used to form the first inlet passage section. A solution which is particularly expedient with regard to sound attenuation provides for the first inlet passage section to be formed integrally in a housing section accommodating the screw rotor bores.

It is also advantageous if the second inlet passage section is formed integrally in the housing section which includes the screw rotor bores, thereby preventing the pressure oscillations or pulsations from extending beyond the housing section which accommodates the screw rotor bores, and thus allowing the pulsations to be effectively restricted to the region where they are formed.

There is a very wide range of options in terms of the control of the refrigerant to be supplied via the refrigerant injection. By way of example, it would be conceivable, in order to control the injection of refrigerant, to fit an expansion valve known from the prior art outside the compressor housing, by means of which valve it is possible not only to control the quantity of refrigerant to be injected but also, at the same time, to effect expansion the refrigerant that is to be injected.

However, it is particularly advantageous if a control valve is disposed in the conduit system of the refrigerant injection for the purpose of controlling the refrigerant that is to be injected via the injection opening.

A control valve of this type is preferably formed as a pure control valve, which in particular has no additional expansion functions and is therefore much less expensive than an expansion valve, in particular a controlled expansion valve.

With regard to actuation of the control valve, it has proven particularly expedient to provide a control unit which determines the temperature of the screw compressor and opens the control valve if a temperature threshold is exceeded.

This determination of the temperature can be carried out in a wide range of ways.

In one possible option, there is provision for the temperature of the compressor housing to be recorded, for example, in the region of the refrigerant outlet, by means of a sensor.

Another option is to record the temperature of the compressed refrigerant downstream of the refrigerant outlet, for example by measuring the temperature of the conduit system connected to the screw compressor or the temperature of the compressed refrigerant itself.

In all cases in which an expansion valve is not provided outside the screw compressor, it is preferably provided that the conduit system of the refrigerant injection carries liquid refrigerant to the injection opening, so that there is substantially no deliberate evaporation of the liquid refrigerant upstream of the injection opening.

Moreover, this object is achieved, in addition or as an alternative to the solutions described above, in a screw compressor of the type described in the introduction, by virtue of the fact that, according to the invention, an injection opening disposed in the compressor housing forms a throttling location with a diameter in the range from approximately 1 mm to approximately 4 mm, or more preferably approximately 3 mm.

In principle, it would in this case also be possible for an expansion nozzle to be provided upstream or downstream of the injection opening.

To achieve the object mentioned in the introduction, as an alternative or in addition to the solutions described above, it is also particularly expedient if the injection opening itself acts as an expansion nozzle for the liquid refrigerant.

This solution is particularly advantageous since it means that the expansion of the refrigerant takes place while it is still inside the compressor housing, specifically substantially in the first inlet passage section, and therefore the cooling action of the refrigerant also only commences within the compressor housing, and therefore as close as possible to the compression spaces in which the refrigerant is compressed on its usual path through the screw compressor, so that the additional refrigerant which enters the compression spaces via the inlet then leads to optimum cooling of the refrigerant contained in the compression spaces.

Furthermore, the expansion of the refrigerant in the region of the first inlet passage section moreover leads directly to efficient cooling of the regions of the compressor housing which are located close to the screw rotor bores, and therefore also to efficient cooling of the regions of the compressor housing which are subject to strong thermal loads.

The solution according to the invention can in particular also be used for screw compressors with a control slide, provided that the inlet is then disposed in such a way in the control slide that it can be displaced with the latter, so that the refrigerant which is additionally used to cool the screw compressor is carried along by the screw rotors substantially without any reduction in the power of the screw compressor.

In this context, it is expediently provided that the inlet in the control slide is connected to the injection opening via a section, which is of variable length, of the first inlet passage section, so that the control slide can be adjusted in a simple way.

This can be realized in a particularly favorable way if the variable-length section of the first inlet passage section is configured in telescopic form.

A telescopic realization of the inlet passage section of this type can be achieved in particular by the variable-length section of the first inlet passage section being formed by a connecting tube which can slide into a receiving passage.

Further features and advantages of the invention form the subject matter of the following description and the appended drawings of an embodiment.

BRIEF DESCRIPTION OF THE DRAWINGS

FIG. 3 shows a section, in the form of an enlarged excerpt, corresponding to FIG. 2 in the region of control slide and screw rotors, and.

DETAILED DESCRIPTION OF THE INVENTION

Figure 1:
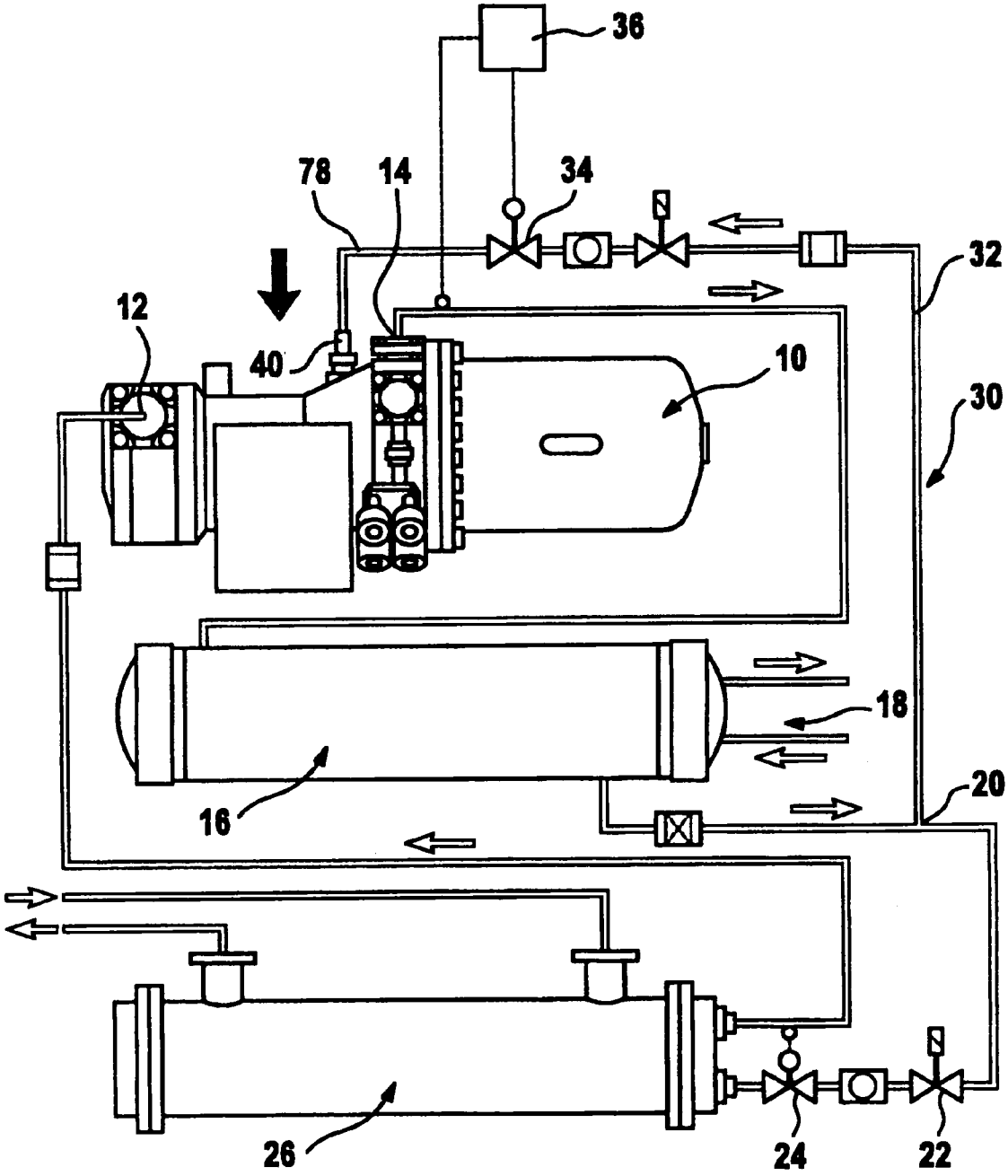
FIG. 1 shows an exemplary embodiment of a screw compressor according to the invention installed in a cooling circuit and provided with a refrigerant injection.

A first exemplary embodiment of a screw compressor according to the invention, illustrated in FIG. 1, comprises a compressor housing, which is denoted overall by reference number 10 and on which a suction connection 12 and a pressure connection 14 are provided, refrigerant being sucked in at the suction connection 12 and compressed refrigerant being delivered at the pressure connection 14.

The compressed refrigerant delivered at the pressure connection 14 is first of all fed to a liquefier 16 in a cooling circuit 18, and from the liquefier 16 passes as liquid refrigerant to a branching point 20, from which the cooling circuit 18 leads onward to a solenoid valve 22 and to a downstream expansion valve 24 and then to an evaporator 26, from which the refrigerant that has been evaporated in the evaporator 26 is then conducted back to the suction connection.

In addition to the cooling circuit 18, a refrigerant injection 30 is provided, which branches off from the cooling circuit 18 at the branching point 20 and leads, by means of a conduit system 32, to a control valve 34, which can be controlled by a control unit 36, the control unit 36 using as control variable a temperature in the region of the pressure connection 14 of the compressor housing, for example measuring the temperature of the compressed refrigerant emerging from the pressure connection 14 immediately downstream of the pressure connection 14.

From the control valve 34, the conduit system 32 leads to a connection 40, provided on the compressor housing 10, for the refrigerant injection 30.

Figure 2:
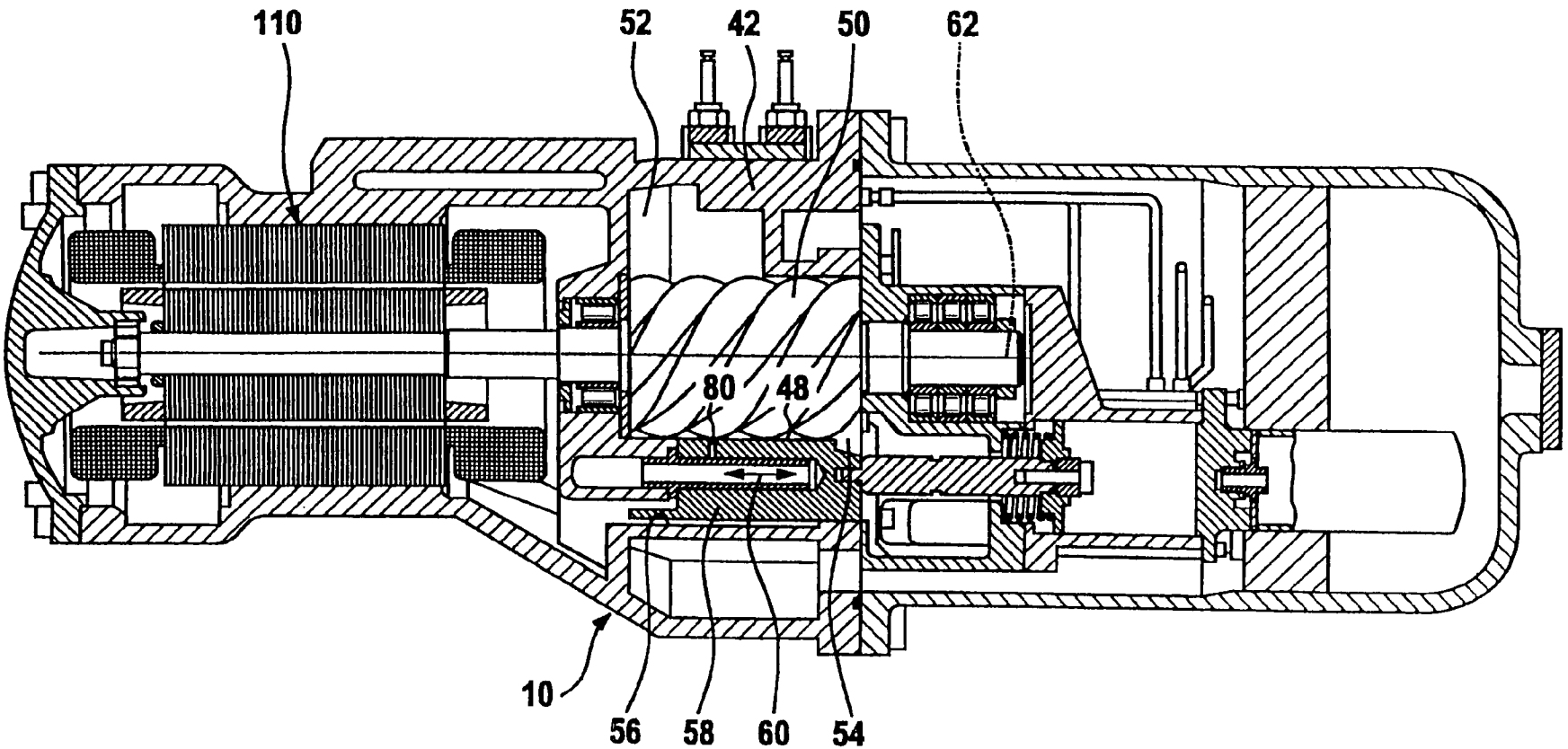
FIG. 2 shows a longitudinal section through the screw compressor.
Figure 3:
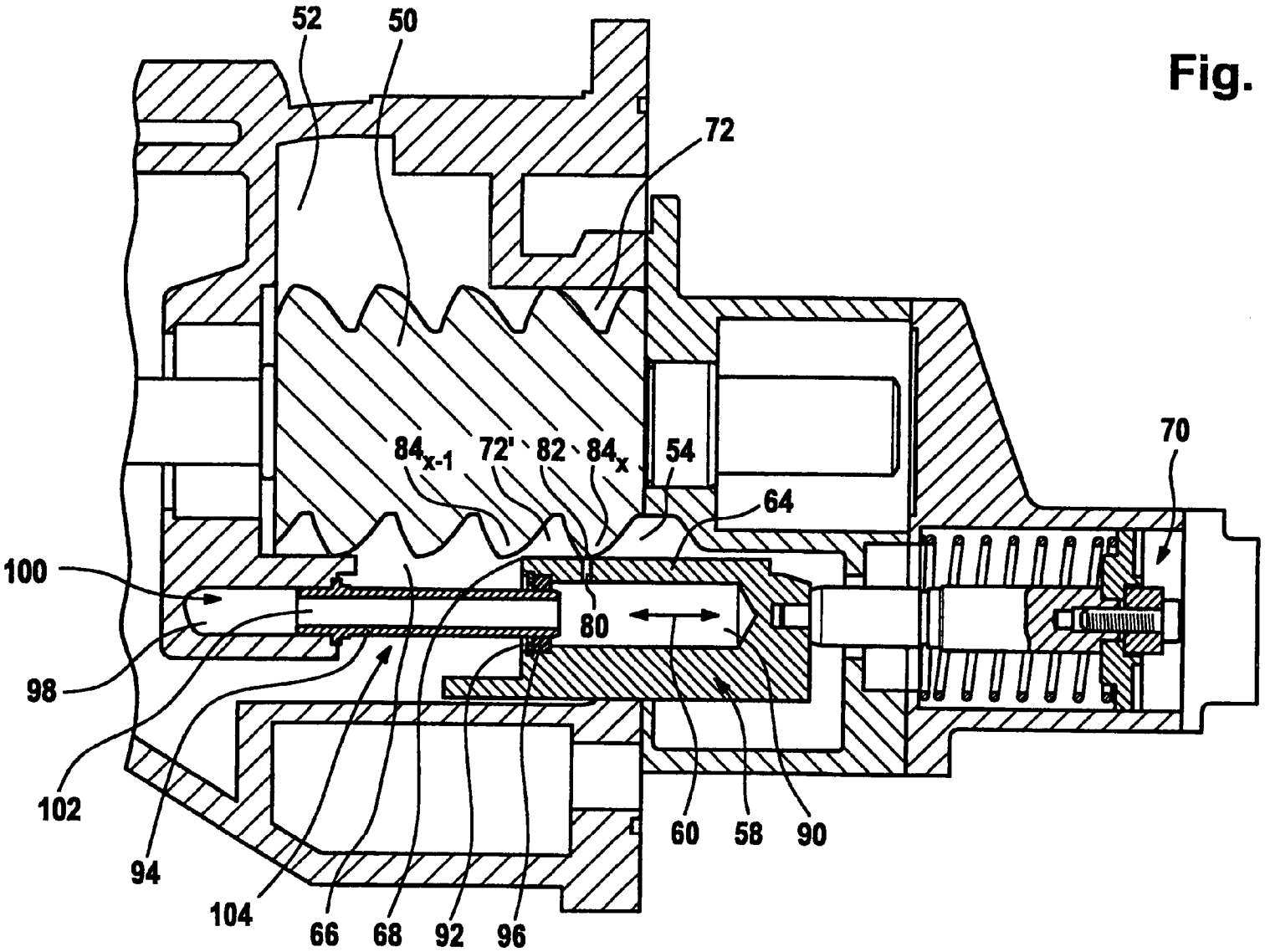
Figure 4:
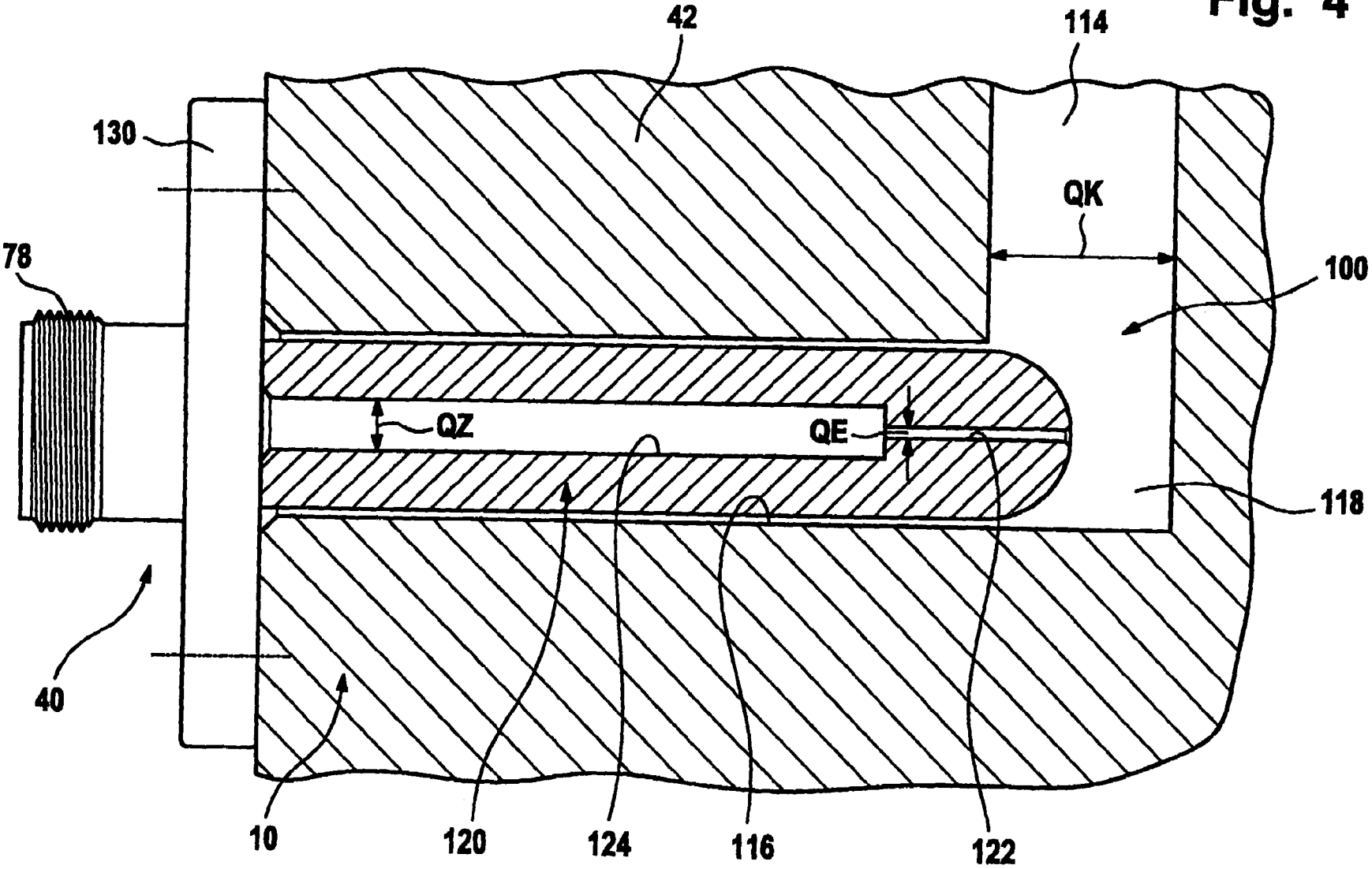
FIG. 4 shows an enlarged illustration, in excerpt form, of an insert part, which can be fitted into a compressor housing starting from an external connection, with an injection opening.

A first exemplary embodiment of a screw compressor according to the invention comprises, as illustrated in detail in FIGS. 2 and 3, screw rotor bores 48, which are provided in a screw rotor housing 42 of the compressor housing 10 and in which intermeshing screw rotors 50 are rotatably disposed, the screw rotor bores 48 extending from a suction-side refrigerant inlet 52 to a pressure-side refrigerant outlet 54 of the screw rotor housing 42, and the intermeshing screw rotors 50 sucking in the refrigerant in the region of the refrigerant inlet 52, then compressing it on its way to the refrigerant outlet 54 and delivering it at the refrigerant outlet 54 as compressed refrigerant. Furthermore, in the compressor housing 10 there is provided a recess 56 in which a control slide 58 is movable in a direction 60 which runs parallel to an axis of rotation 62 of the screw rotors 50.

The control slide 58 forms, together with a slide wall 64 facing the screw rotors 50, a wall side of the screw rotor bores 48, which by virtue of the displaceability in direction 60 creates the possibility of controlling the compression that can be achieved by the screw rotors 50. In the position illustrated in FIG. 2, the entire slide wall 64 extends along the screw rotors 50 and creates the possibility of the screw rotors 50 contributing to compression of the refrigerant over their entire length in the direction of their axis of rotation 62, whereas in the position of the control slide 58 illustrated in FIG. 3 the control slide has been displaced to such an extent that only a subregion of the slide wall 64 is adjacent to the screw rotors 50, and therefore the screw rotors 50 only contribute to compressing the refrigerant over part of their length, namely the part which is adjacent to the slide wall 64, while by displacement of the control slide 58 relative to the refrigerant inlet 52, a free space 66 is formed between the latter and a suction-side edge 68 of the control slide 58, which makes the region of the screw rotors 50 which is adjacent to the free space 66 inactive in terms of the compression of the refrigerant.

The control slide 58 is actuable for this by means of a control device 70 which, by way of example, may be formed as described in European Patent Application 1 072 796.

However, it is also possible for the control device 70 to be formed differently, for example to be externally continuously actuable.

To enable the refrigerant injection 30 to operate efficiently in all positions of the control slide 58, it is necessary for the refrigerant which comes out of the supercooling circuit 30 and is to be sucked in by the screw compressor to be fed, in all positions of the control slide 58, to a compression space 72 which is delimited by the screw rotors 50 and the screw rotor bores 48 as well as the slide wall 64 and in which the refrigerant is at a pressure level that is higher than the pressure level in the refrigerant inlet 52 and lower than the pressure level in the refrigerant outlet 54.

For this reason, an inlet 80 for the refrigerant supplied for cooling from the refrigerant injection 30 via a conduit system 78 thereof is provided in the control slide 58, in the form of a bore passing through the slide wall 64, an inlet opening 82 which opens out into the compression space 72 always being positioned in such a way that a compression space 72, which is closed off with respect to the refrigerant inlet 52 and the refrigerant outlet 54, is always positioned above it, or the inlet opening 82 is closed off by a screw crest $\mathbf{84}_x$.

As illustrated in FIG. 3, in the position of the screw rotors 50 shown in FIG. 3, the screw crest $\mathbf{84}_x$ is just closing the inlet opening 82, while a future space 72', which is initially still open toward the refrigerant inlet 52 and is closed off with respect to the refrigerant inlet 80 as the screw rotors 50 continue to rotate, by the following screw crest $\mathbf{84}_{x-1}$, and then comes to lie above the inlet opening 82, is forming, so that by the end of these steps there is a connection between the inlet 80 and this compression space, which is then closed, and refrigerant can flow into this compression space via the inlet 80.

The inlet opening 82 is preferably positioned in such a way that it opens out into the first compression space 72, which is closed off with respect to the refrigerant inlet 82 by the screw crests 84.

In the exemplary embodiment illustrated, the inlet 80 is connected to a central receiving passage 90, which extends in the direction 60 within the control slide 58 and on one side has an opening 92, via which a connecting tube 94 held on the compressor housing 10 projects into this receiving passage, a seal 96 being provided between the central receiving passage 90 and the connecting tube 94, and the length of the connecting tube 94 being such that in every position of the control slide 58 it projects into the central receiving passage 90, sealed by the seal 96, without impeding the displaceability of the control slide 58 between the intended control positions.

The connecting tube 94 is connected to a housing passage 98 which runs within the compressor housing 10 and is routed to the connection 40 on the compressor housing 10.

An inlet passage 100, running within the compressor housing 10, between the connection 40 and the inlet 80 in the compressor housing 10 is therefore formed by the housing passage 98, a passage 102 running within the connecting tube 94 and the central receiving passage 90 in the control slide 58, from which the inlet 80 branches off, the connecting tube 94 and the receiving passage 90 forming a variable-length section 104 of the inlet passage 100.

Since—as has already been described—the screw crests 84 of the screw rotors 52 always continue beyond the inlet opening 82, and therefore a newly formed compression space 72 is constantly being connected to the inlet 80 again, pressure oscillations or pulsations are formed in the inlet passage 100 with a basic frequency which results from the rotational speed of the screw rotors 50, driven by a motor 110, multiplied by the number of screw crests 84 of the screw rotors 50.

The inlet passage 100 is divided into a first inlet passage section 114, which comprises part of the housing passage 98 and the passage 102 running within the connecting tube 94, and the central receiving passage 90 in the control slide 58, and a second inlet passage section 116, which, starting from the connection 40 provided at the compressor housing 10, runs within the compressor housing 10 and merges into the first passage section 114, for example in the region of a turn 118.

To prevent the pressure oscillations or pulsations which have been described from propagating outside the compressor housing 10 into the conduit system 78 of the refrigerant injection 30, an insert part 120 is fitted into the second inlet passage section 116, which insert part extends from the connection 40 via the second inlet passage section 116 and has an injection opening 122 which is disposed facing the first passage section 114 and the cross-sectional area QE of which is less than approximately one hundredth of a cross-sectional area QK, the cross-sectional area QE being, for example, in the range from approximately 4 mm to 3 mm, or even better approximately 1 mm to approximately 3 mm or 2 mm.

The injection opening 122 is preferably capillary-like in form and acts in particular as a nozzle, by means of which liquid refrigerant supplied from the injection opening 122 can be expanded in the subsequent first passage section 114, in order to cool the screw rotor housing 42 as early as in the first passage section 114.

The refrigerant which has been expanded and therefore cooled then enters the compression spaces 72 which are forming via the first passage section 114 and the inlet 80 and therefore also directly cools the refrigerant, which has been delivered into these compression spaces 72 from the refrigerant inlet 52 to the refrigerant outlet 54, and in addition also the screw rotors 50.

It is preferable for the liquid refrigerant to be fed to the injection opening 122 via a feed passage 124 in the insert part 120, the cross-sectional area QZ of which likewise corresponds to a multiple of the cross-sectional area QE of the injection opening 122, so that the injection opening 122 represents the actual throttling location during the supply of liquid refrigerant, after which the liquid refrigerant is expanded, so that the expanded refrigerant can take up heat.

The liquid refrigerant then enters the feed passage 124 from the side of the conduit system 78 of the refrigerant injection 30 in the region of the connection 40 provided on the compressor housing 10.

It is then preferable for the insert part 120 itself to be fixedly connected to a connection flange 130 for the conduit system 78, the connection flange 130 being mounted on the compressor housing 10, so that the insert part 120 extends from the connection flange 130 into the second inlet passage section 116 and is held fixed therein by way of the connection flange 130.

On account of the fact that the injection opening 122 serves as the actual throttle for the liquid refrigerant that is to be evaporated for cooling in the compressor housing 10, it is sufficient for only the control valve 34 to be provided for switching on and off in the conduit system 78, in the form of a solenoid valve actuated by the control unit 36, so that there is preferably no need for an expansion valve in the conduit system 78 in order to enable the liquid refrigerant to be expanded as far as possible directly at the location at which it is to perform its cooling action, namely in the compressor housing 10.

The invention claimed is:

1. Screw compressor, comprising:

a compressor housing, a refrigerant inlet in said compressor housing, a refrigerant outlet in said compressor housing, two screw rotors, which are disposed in screw rotor bores in the compressor housing, said screw rotors compressing a refrigerant that enters at the refrigerant inlet and allowing the refrigerant to leave at the refrigerant outlet, a cooling inlet, for additional refrigerant provided in the compressor housing at a portion of said compressor housing having a pressure level that is higher than the pressure level at said refrigerant inlet, said additional refrigerant being supplied by a refrigerant injection via a conduit system, for additional cooling of the screw compressor, the cooling inlet being disposed in such a manner that it opens out in compression spaces surrounded by the screw rotors and the screw rotor bores, a first inlet passage section being connected to the cooling inlet and running within the compressor housing, a second inlet passage section adjoining said first inlet passage section running within the compressor housing, an insert part fitted in the second inlet passage section, the insert part having a feed passage leading to an injection opening for the additional refrigerant supplied by the refrigerant injection, said injection opening opening out in said first inlet passage section, the feed passage having a larger cross-sectional area than the injection opening, and a cross-sectional area of the injection opening being smaller by more than a factor of approximately four than a cross-sectional area of the first inlet passage section.

2. Screw compressor according to claim 1, wherein the injection opening has a cross-sectional area which is smaller by more than a factor of approximately ten than the cross-sectional area of the first inlet passage section.

3. Screw compressor according to claim 1, wherein the insert part is fixed in the second inlet passage section.

4. Screw compressor according to claim 1, wherein the insert part extends from an outer connection on the compressor housing into the second inlet passage section.

5. Screw compressor according to claim 1, wherein the first inlet passage section is formed integrally in a housing section accommodating the screw rotor bores.

6. Screw compressor according to claim 5, wherein the second inlet passage section is formed integrally in the housing section which includes the screw rotor bores.

7. Screw compressor according to claim 1, wherein a control valve is disposed in the conduit system of the refrigerant injection for the purpose of controlling the refrigerant that is to be injected via the injection opening.

8. Screw compressor according to claim 1, wherein:

the compressor housing comprises a displaceable control slide, and the cooling inlet is disposed in and displaceable with the control slide.

9. Screw compressor according to claim 8, wherein the cooling inlet in the control slide is connected to the injection opening via a section, which is of variable length, of the first inlet passage section.

10. Screw compressor according to claim 9, wherein the variable-length section of the first inlet passage section is configured in telescopic form.

11. Screw compressor according to claim 10, wherein the variable-length section of the first inlet passage section is formed by a connecting tube which is slideable into a receiving passage.

12. Screw compressor, comprising:

a compressor housing, a refrigerant inlet in said compressor housing, a refrigerant outlet in said compressor housing, two screw rotors, which are disposed in screw rotor bores in the compressor housing, said screw rotors compressing a refrigerant that enters at the refrigerant inlet and allowing the refrigerant to leave at the refrigerant outlet, a cooling inlet for additional refrigerant provided in the compressor housing at a portion of said compressor housing having a pressure level that is higher than the pressure level at said refrigerant inlet, said additional refrigerant being supplied by a refrigerant injection via a conduit system, for additional cooling of the screw compressor, the cooling inlet being disposed in such a maimer that it opens out in compression spaces surrounded by the screw rotors and the screw rotor bores, a first inlet passage section being connected to the cooling inlet and running within the compressor housing, an injection opening for the additional refrigerant supplied by the refrigerant injection, said injection opening opening out in said first inlet passage section, a cross-sectional area of the injection opening being smaller by more than a factor of approximately four than a cross-sectional area of the first inlet passage section, a control valve disposed in the conduit system for the purpose of controlling the additional refrigerant that is to be injected via the injection opening, the control valve being actuated by a control unit which determines a temperature of the screw compressor and opens the control valve if a temperature threshold is exceeded.

13. Screw compressor according to claim 12, wherein the additional refrigerant comprises substantially liquid refrigerant carried by the conduit system to the injection opening.

14. Screw compressor, comprising:

a compressor housing, a refrigerant inlet in said compressor housing, a refrigerant outlet in said compressor housing, two screw rotors, which are disposed in screw rotor bores in the compressor housing, said screw rotors compressing a refrigerant that enters at the refrigerant inlet and allowing the refrigerant to leave at the refrigerant outlet, a cooling inlet for additional refrigerant provided in the compressor housing at a portion of said compressor housing having a pressure level that is higher than the pressure level at said refrigerant inlet, said additional refrigerant being supplied by a refrigerant injection via a conduit system, for additional cooling of the screw compressor, the cooling inlet being disposed in such a manner that it opens out in compression spaces surrounded by the screw rotors and the screw rotor bores, an inlet passage section being connected to the cooling inlet and running within the compressor housing, an injection opening disposed in the inlet passage section forming a throttling location with a diameter in the region of approximately 1 mm to approximately 4 mm.

15. Screw compressor, comprising:

a compressor housing, a refrigerant inlet in said compressor housing, a refrigerant outlet in said compressor housing, two screw rotors, which are disposed in screw rotor bores in the compressor housing, said screw rotors compressing a refrigerant that enters at the refrigerant inlet and allowing the refrigerant to leave at the refrigerant outlet, a cooling inlet for additional refrigerant provided in the compressor housing at a portion of said compressor housing having a pressure level that is higher than the pressure level at said refrigerant inlet, said additional refrigerant being supplied by a refrigerant injection via a conduit system, for additional cooling of the screw compressor, the cooling inlet being disposed in such a manner that it opens out in compression spaces surrounded by the screw rotors and the screw rotor bores, a first inlet passage section being connected to the cooling inlet and running within the compressor housing, an injection opening for the additional refrigerant supplied by the refrigerant injection, said injection opening opening out in said first inlet passage section, the injection opening acting as an expansion nozzle providing expanded liquid refrigerant in said first inlet passage section.

* * * * *

UNITED STATES PATENT AND TRADEMARK OFFICE

CERTIFICATE OF CORRECTION

PATENT NO. : 7,201,569 B2
APPLICATION NO. : 11/144150
DATED : April 10, 2007
INVENTOR(S) : Hossner It is certified that error appears in the above-identified patent and that said Letters Patent is hereby corrected as shown below:

Column 8, line 61: correct “maimer” to read --manner--.

Signed and Sealed this

Twelfth Day of June, 2007

JON W. DUDAS
*Director of the United States Patent and Trademark Office*